US007978213B2

(12) United States Patent
Koshimura et al.

(10) Patent No.: US 7,978,213 B2
(45) Date of Patent: Jul. 12, 2011

(54) FOCUS ADJUSTMENT METHOD OF LED PRINT HEAD AND IMAGE FORMING APPARATUS

(75) Inventors: Yasushi Koshimura, Tokyo (JP); Toru Yamaguchi, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 969 days.

(21) Appl. No.: 11/839,237

(22) Filed: Aug. 15, 2007

(65) Prior Publication Data

US 2008/0068439 A1 Mar. 20, 2008

(30) Foreign Application Priority Data

Sep. 19, 2006 (JP) ..... 2006-252416

(51) Int. Cl.
*B41J 2/45* (2006.01)

(52) U.S. Cl. ..... 347/238

(58) Field of Classification Search ..... 347/244, 347/258, 229, 234–238, 246–250
See application file for complete search history.

(56) References Cited

U.S. PATENT DOCUMENTS

| | | | | |
|---|---|---|---|---|
| 6,687,028 | B1 * | 2/2004 | Kasahara et al. | 358/509 |
| 7,154,525 | B2 * | 12/2006 | Oda et al. | 347/241 |
| 2002/0021347 | A1 * | 2/2002 | Kitayama et al. | 347/138 |

FOREIGN PATENT DOCUMENTS

| | | | |
|---|---|---|---|
| JP | 2001-113763 | | 4/2001 |
| JP | 2001116983 A | * | 4/2001 |
| JP | 2001-125347 | | 5/2001 |

* cited by examiner

*Primary Examiner* — Hai C Pham
(74) *Attorney, Agent, or Firm* — Cantor Colburn LLP

(57) ABSTRACT

A focus adjustment method of an LED print head of an image forming apparatus, including steps of: setting one end with respect to a longitudinal direction of the LED print head on a first position where a distance between the photoconductor and the LED print head becomes shorter than a designed focal length, and setting other end with respect to the longitudinal direction of the LED print head on a second position where the distance between the photoconductor and the LED print head becomes longer than the designed focal length; outputting a pattern image having a predetermined resolution; and adjusting the position of the LED print head by moving each of the one end and the other end of the LED print head, based on information of the resolution of the outputted pattern image.

16 Claims, 4 Drawing Sheets

FOCUS ADJUSTMENT METHOD OF LED PRINT HEAD AND IMAGE FORMING APPARATUS

This application is based on Japanese Patent Application No. 2006-252416 filed on Sep. 19, 2006 with the Japanese Patent Office, the entire content of which is hereby incorporated by reference.

FIELD OF THE INVENTION

The present invention relates to a focus adjustment method of an LED print head mounted on an image forming apparatus.

BACKGROUND OF THE INVENTION

Generally, concerning image forming apparatuses using an electro-photographing method, such image forming apparatuses are well known which incorporate an LED print head (hereinafter referred to as an LPH) featuring a light source structured of an LED array formed of a plurality of LEDs, and which expose image information onto a photo-conductive drum (which serves as an image carrier) to form a latent image. The LPH concentrates light rays using an optical system, generally called a Selfoc lens which is a convergent rod lens array, so that the LPH exhibits high resolution. However, if the distance between the LPH and the photo-conductive drum changes, the exposed image becomes out of focus, and the resolution decreases. Further, in color image forming apparatus in which a plurality of mono-color images are superposed, color unevenness occurs, which is a major problem.

In order to obtain preferable images, the positional accuracy between the LPH and a focusing plate of the photoconductive drum must be within ±0.05 mm. Due to this, the focus adjustment was very difficult to achieve for an LPH incorporating a plurality of aligned LEDs.

In order to overcome the above problem, the unexamined Japanese Patent Application Publication No. JP2001-113,763 discloses a technology in which a correction value for print head assembling error is memorized when a head shading correction value is measured and calculated, and to output normal images, when a head shading table is set, referring to the difference between the then correction value of the print head assembling error and the correction value of the print head assembling error memorized when the head shading correction value was measured, an image element on which the shading correction is to be conducted is shifted by a changed amount of the print head.

Further, the unexamined Japanese Patent Application Publication No. 2001-125,347 discloses in which after a line-image pattern is formed on the photoconductive drum as an electro-static latent toner image, the line width of the toner image of the line-image pattern formed on the photoconductive drum is detected, and a print head position adjusting mechanism is controlled based on the detected line width of the toner line-image pattern, whereby the position in the optical axial direction of the LED print head is adjusted so that the line width of the detected toner image becomes within a predetermined value.

In the former Patent Publication No. 2001-113,763, even when the print head assembling error changes due to an exchange of the print head or any vibration of the apparatus, each print head element can be correctively referred to a correction table for the density unevenness, so that the head shading correction is effectively conducted on each print element. Accordingly, correction for the density unevenness is improved.

However, since only the amount of exposure light is adjusted as above, the defocusing problem cannot be overcome, which does not improve any decrease of the resolution. Reduction of the image quality due to the uneven density is barely prevented.

In the previous Patent Publication No. 2001-125,347, after the width of the line-image pattern formed on the photoconductive drum is detected, the position of the LPH in the optical axial direction is adjusted based on the detected line width. However, any decline of the LPH in the longitudinal direction of the LEDs, that is, a decline of the LPH in the axial direction of the photoconductive drum, is not adjusted, and further requires a line-width detecting mechanism, which results in a larger apparatus, and an increase of the production cost. Further, since the line width depends upon the image forming condition, such as the exposure amount, and the developing bias, it is not clear whether optimum focusing is obtained by said Patent Publication.

SUMMARY OF THE INVENTION

The present invention has been achieved in view of the above conditions, and an object of the present invention is to provide a focus adjustment method for the LPH, wherein an optimum focus position detection for the LPH is conducted by a simple structure, the focus adjustment is conducted by a simple structure based on the focus position detection, and the decline of the LPH is adjusted.

The object of the present invention can be attained by the methods and structures described below.

(1) In a focus adjustment method for an LED print head of an image forming apparatus, including an LED print head in which an LED array, formed of a plurality of LEDs to form an electrostatic latent image on a photoconductor, is arranged in the longitudinal direction of the photoconductor, the focus adjustment method includes steps of:

setting one end of the LED print head at a first position where the distance between the photoconductor and the LED print head becomes shorter than the designed focal length, and setting the other end of the LED print head at a second position where the distance between the photoconductor and the LED print head becomes longer than the designed focal length, outputting a pattern image having a predetermined resolution, and adjusting the position of the LED print head by moving each of one end and the other end of the LED print head, based on information of the resolution of the outputted pattern image.

(2) An image forming apparatus including a print head to form an electrostatic latent image on a photoconductor, including:

a photoconductor;

an LED print head including an LED array which is structured of plural LEDs to form the electrostatic latent image on the photoconductor and is arranged in a longitudinal direction of the photoconductor;

a position adjusting section which individually moves one end and other end with respect to a longer direction of the LED print head to change a position of the LED print head;

a pattern forming section which forms a pattern image having a predetermined resolution to output; and a resolution information obtaining section which obtains information of the resolution with respect to the longitudinal direction of the LED print head.

DETAILED DESCRIPTION OF THE INVENTION

Figure 1:
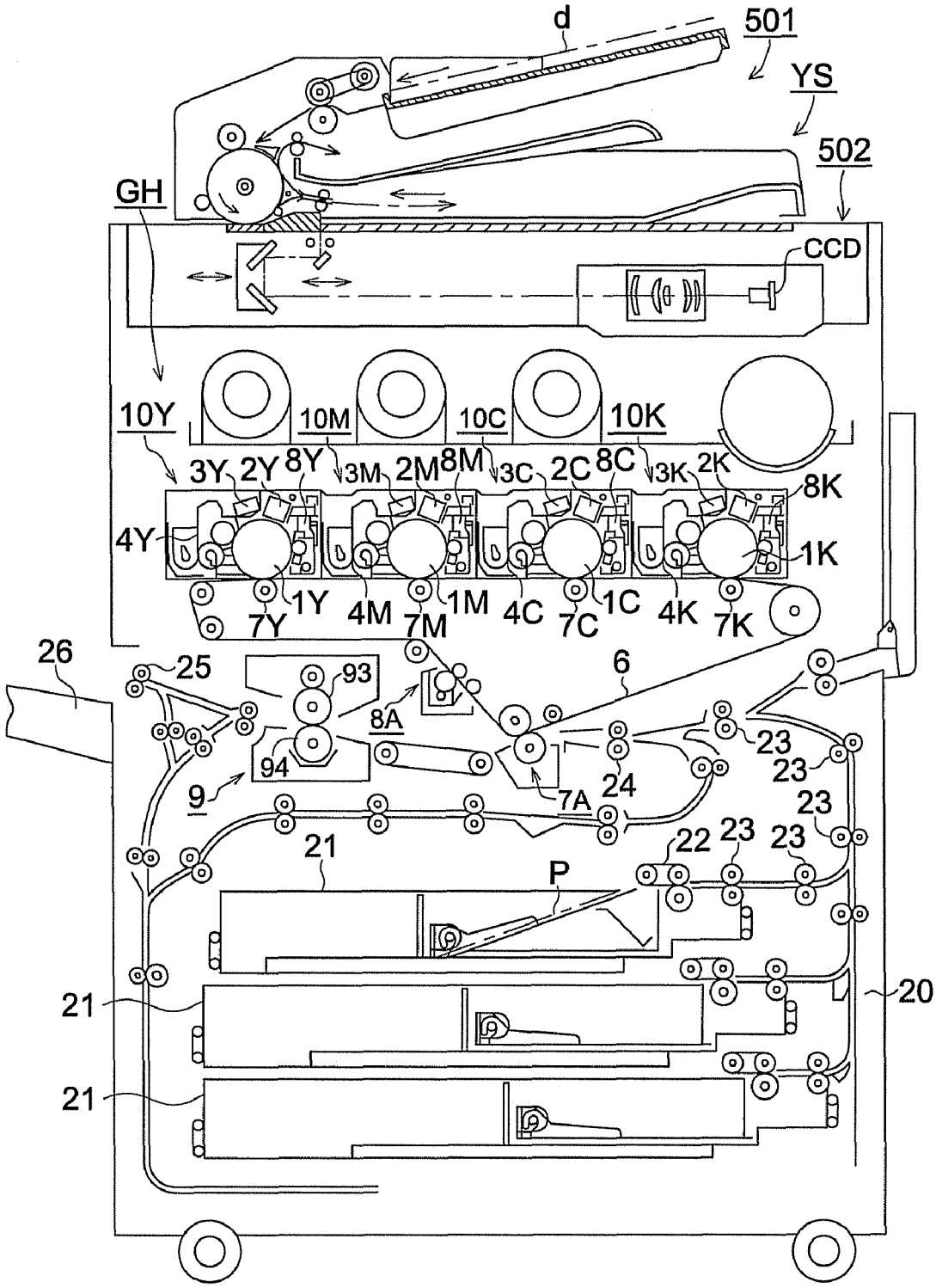
FIG. 1 shows an image forming apparatus on which the LPH focus adjustment method relating to the present invention is applied.

An embodiment of the present invention will now be detailed while referring to the drawings.

FIG. 1 shows an example of an image forming apparatus on which the LPH focus adjustment method of the present invention can be applied, however the image forming apparatus of the present invention is not limited to the following embodiments.

The present image forming apparatus is structured of image forming apparatus main body GH and image reading apparatus YS.

Image forming apparatus main body GH is referred to as a tandem-type color image forming apparatus, which is structured of a plurality of image forming sections 10Y, 10M, 10C and 10K, serving as an image forming means, intermediate transfer body 6, being a belt and serving as an image carrier, transfer section 7A, sheet supply section 20 and fixing section 9.

On an upper section of image forming apparatus main body GH, image reading apparatus YS is installed, which is formed of automatic document feeding apparatus 501 and document image scanning exposure apparatus 502. Document "d", placed on a document platen of automatic document feeding apparatus 501, is conveyed by a feeding section so that the image carried on a single surface or on both surfaces of document "d" are scanned by an optical system of document image scanning exposure apparatus 502, whereby the images are read by line image sensor CCD.

The read images are photo-electronically converted by line image sensor CCD to electronic signals, and an analog process, an A/D conversion, a shading correction and an image compressing process are conducted on said electronic signals by an image processing section. Subsequently, conducted electronic signals are sent to LPHs 3Y, 3M, 3C and 3K, which serve as exposure sections.

Image forming section 10Y, to form the yellow portion of images, includes electric charging section 2Y, LPH 3Y, developing device 4Y, and cleaning section 8Y, arranged around photoconductive drum 1Y serving as an image carrier.

Image forming section 10M, to form the magenta portion of images, includes electric charging section 2M, LPH 3M, developing device 4M, and cleaning section 8M, around photoconductive drum 1M.

Image forming section 10C, to form the cyan portion of images, includes electric charging section 2C, LPH 3C, developing device 4C, and cleaning section 8C, arranged around photoconductive drum 1C.

Image forming section 10K to form black images includes electric charging section 2K, LPH 3K, developing device 4K, and cleaning section 8K, around photoconductive drum 1K.

Latent image forming sections are formed of electric charging section 2Y and LPH 3Y, electric charging section 2M and LPH 3M, electric charging section 2C and LPH 3C, and electric charging section 2K and LPH 3K.

Dual component developers, including small particle toner and carriers for yellow, magenta, cyan and black, are used in developing devices 4Y, 4M, 4C and 4K, respectively.

Intermediate transfer body 6 is entrained about a plurality of rollers, and rotates.

Developing device 9 in the present embodiment serves as a heated roller fixing device, which incorporates fixing roller 93 having a heating device, and pressure applying roller 94 to press against fixing roller 93. Developing device 9 nips recording sheet P, carrying the toner image, between fixing roller 93 and pressure applying roller 94, whereby the toner image is heated and pressed to be fixed on sheet P.

That is, each color image formed by image forming sections 10Y, 10M, 10C, and 10K is sequentially transferred onto rotating intermediate transfer body 6 by transfer sections 7Y, 7M, 7C and 7K (each being a first transfer process), whereby toner image compounded of said four color images is formed.

Recording sheets P, accommodated in sheet supply cassette 21, serving as a recording sheet storing section, are picked up one by one by sheet supply rollers 22 of sheet supply section 20, and conveyed to paired registration rollers 24, which are in a stopped state, through various paired sheet supply rollers 23, where Sheet P is temporally stopped. Via synchronous timing so that the position of the leading edge of sheet P and the position of the toner image on intermediate transfer body 6 are correctly matched, registration rollers 24 start rotation so that sheet p is conveyed to transfer section 7A, where the color image is transferred onto recording sheet P (which is a secondary transfer process). After recording sheet P, on which the full-color image has been transferred, is heated and pressed by fixing section 9 to be fixed, it is ejected onto exterior sheet tray 26 by paired sheet ejection rollers 25.

Additionally, intermediate transfer body 6, which transferred the color image onto recording sheet P and separated sheet P at its curved section, is cleaned by cleaning section 8A, so that remaining toner is cleared away.

Further, the above explanation is for an image forming apparatus to form full-color images, but an image forming apparatus to form monochromatic images is obviously also possible.

Fixing device 9 in the present embodiment is a device using a heated roller, however, a fixing device using a belt is also possible to use.

Next, the focus adjustment for LPH is detailed.

In the present embodiment, a position adjustment mechanism is provided on each LPH 3Y, 3M, 3C and 3K, which changes a position in each optical direction, whereby the position is a distance between each LPH 3Y, 3M, 3C and 3K, and each photoconductor 1Y, 1M, 1C and 1K, respectively. Since the position adjustment mechanisms provided on each LPH 3Y, 3M, 3C and 3K have the same structure, the focus adjustment of LPH 3Y will be detailed.

Figure 2:
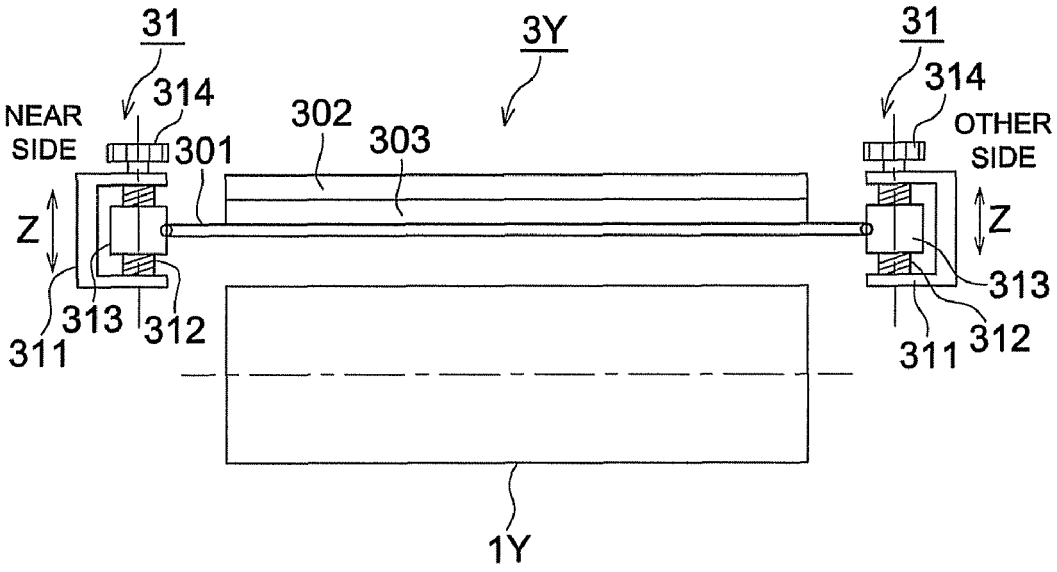
FIG. 2 shows a schematic structure of the position adjusting mechanism of the LPH.

FIG. 2 shows the schematic structure of the position adjusting mechanism of the LPH 3Y. In this figure, the left side of FIG. 1 is the near side, while the right side is the other side.

LPH 3Y, structured of LED array 302 and Selfoc lens 303, and mounted on support member 301, is located in the axial direction of photoconductor 1Y. LPH 3Y uses LED array 302 as a light source, wherein LED array 302 is formed of a plurality of LEDs, and aligned in the axial direction of photoconductor 1Y. Selfoc lens 303, also aligned in the axial direction of photoconductor 1Y, concentrates light rays emitted from LED array 302 onto photoconductor 1Y.

Position adjustment mechanisms 31, provided on both sides of support member 301, are structured of base 311, adjustment screw 312, moving piece 313 which is driven in the directions shown by arrow Z by the rotation of adjustment screw 312, and knob 314 by which an operator rotates adjustment screw 312. In this embodiment, knob 314 is rotated by the operator, however, it is possible to rotate it by a driving means which is not illustrated, such as a stepping motor or the like.

Both ends of supporting member 301 are pivotally mounted on each moving piece 313, to rotate in directions of arrow Z. When each adjustment screw 312 rotates due to the rotation of each knob 314, each moving piece 313 moves in the directions of arrow Z. When each moving piece 313 moves, the one end of LPH 3Y and the other end of LPH 3Y mounted on supporting member 301 individually move in the directions of arrow Z. A scale is provided on each knob 314 to show the moving distance. Further, in order to prevent moving piece 313 from moving while the operation, it is preferable to provide a locking member (which is not illustrated) to lock moving piece 313 on each knob 314 or adjustment screw 312.

Position adjustment mechanism 31 is not limited to the present embodiment, for example, a rack-and-pinion mechanism may also be used.

LPH focus adjustment method will be detailed below.

Figure 3:
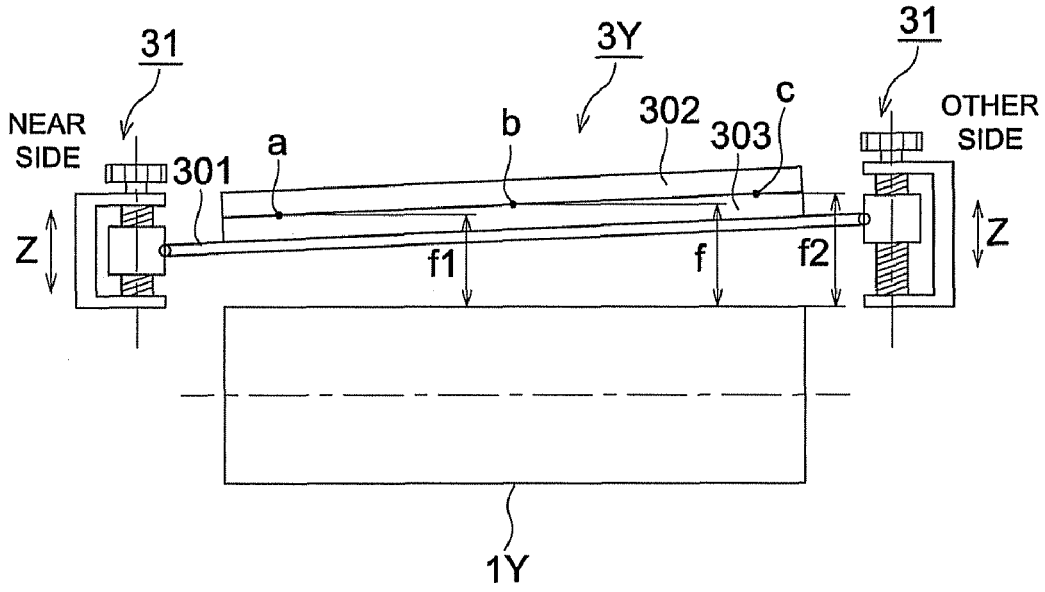
FIG. 3 shows an LPH which is declined and positioned.

Initially, as shown in FIG. 3, one end of LPH 3Y, which is represented by "a", is adjusted so that distance "f1" between "a" and photoconductor 1Y becomes shorter than designed focal distance "f", while the other end of LPH 3Y, which is represented by "c", is adjusted so that distance "f2" between "c" and photoconductor 1Y becomes longer than designed focal distance "f" (which is step 1). Accordingly, LPH 3Y is arranged to be declined to the axial direction of photoconductor 1Y. In the present embodiment, f1=f−0.2 mm, and f2=f+0.2 mm.

Next, in the state set in step 1, the predetermined pattern images, exhibiting readable resolution, is printed on recording sheet P by the pattern forming mode (being step 2).

Figure 4:
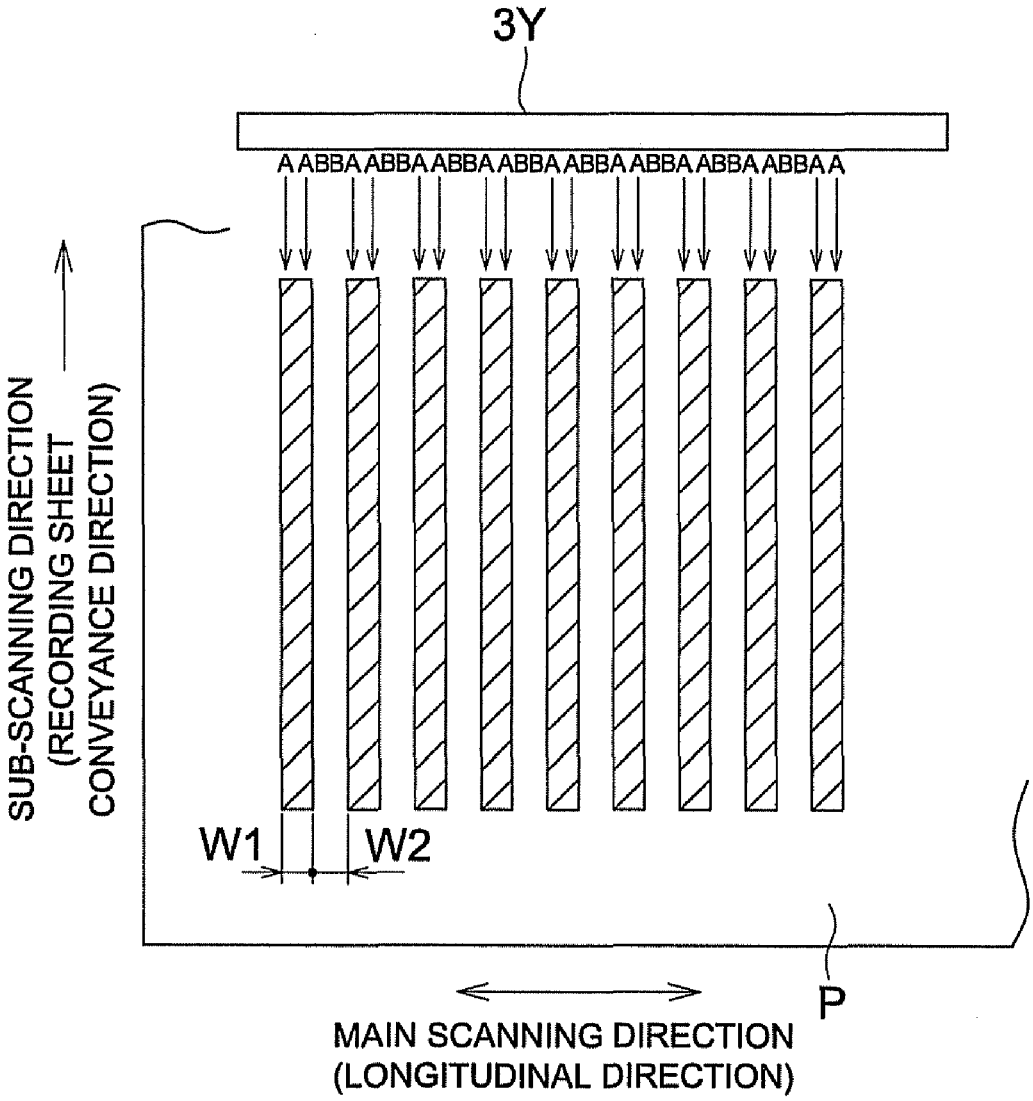
FIG. 4 shows a condition of the pattern image outputted on recording sheet P.

In FIG. 4, within LPH 3Y, set in the main scanning direction, two picture elements are lighted, while adjacent two picture elements are not lighted, which system is repeated. That is, a plurality of lines parallel to the sub-scanning direction are printed on sheet P, which represent the line patterns.

In FIG. 4, symbol A represents a lighted picture element, while symbol B represents an unlighted picture element. Therefore, a plurality of lines are printed on sheet P as line patterns, by the lighted picture elements.

When LPH 3Y is set in a focus position, line width "W1" of said line pattern are nearly equal to clearance "W2" between each line pattern. When LPH 3Y is out of the focus position, width W1 becomes wider, while clearance W2 becomes narrower.

AS described later in FIG. 5(*b*), when the pattern images are to be printed, it is preferable that a numerical value and a scale, displaying the distance between LPH 3Y and photoconductor 1Y, are recorded together on recording sheet P, as an adjusting scale. Due to this, both, the position of the LED, being in an optimum focus position, and the real focal distance, peculiar to the LPH, can be detected and checked with ease.

Further, when designed focal distance f, near side position f1 of LPH 3Y, and other side position f2 of LPH 3Y, need to be changed, the operator inputs a new value through an operation section (which is not illustrated), whereby the values set in the pattern forming mode can be changed.

Next, based on information of the pattern image, printed on recording sheet P, which was outputted in step 2, the position of LPH 3Y is adjusted to a position of higher resolution (step 3).

Figure 5:
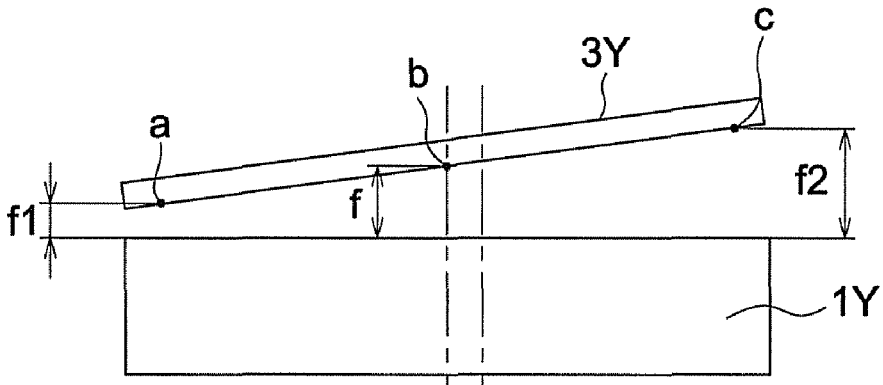
FIG. 5(*a*) shows the positional relationship between LPH 3Y and photoconductive drum 1Y which are set in step 1, while FIG. 5(*b*) shows the outputted pattern image, and FIG. 5(*c*) shows the density distribution of the pattern image.
Figure 5:
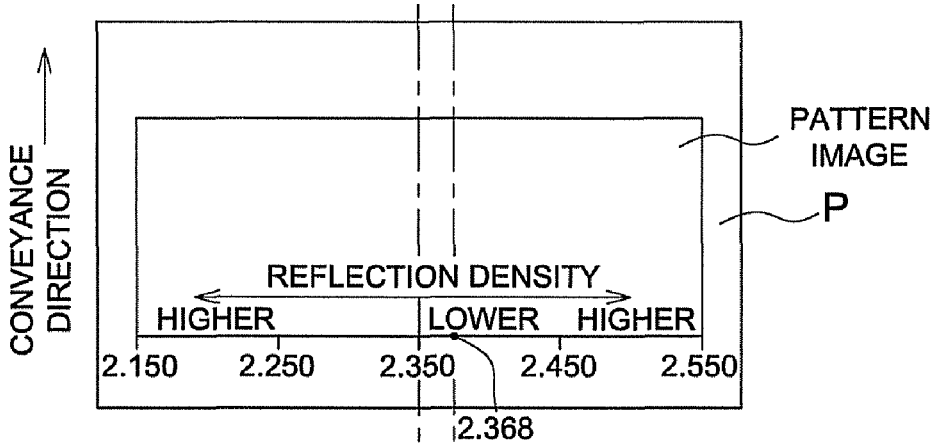
Figure 5:
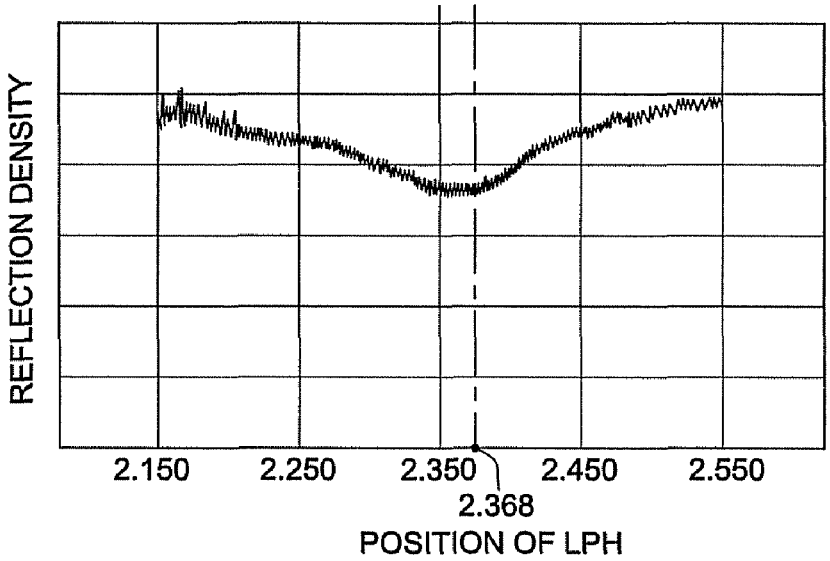

FIG. 5(*a*) shows the positional relationship between LPH 3Y and photoconductor 1Y which are set in step 1 (see FIG. 3 in detail), FIG. 5(*b*) shows the outputted pattern image, and FIG. 5(*c*) shows the density distribution of the pattern image, in which the focal distance is exemplified as f=2.350.

As described above, when LPH 3Y is set in a focus position, line width "W1" of said line pattern is nearly equal to clearance "W2" between each adjacent line pattern, and the density of the line pattern image is lower. When it is out of the focus position, width W1 becomes wider, while clearance W2 becomes narrower, and the density of the line pattern image is higher. Accordingly, as information of the resolution of the pattern image outputted on recording sheet P, the position of LPH 3Y, where the highest resolution is obtained, that is, the focusing position, is the position where the density of the pattern image is the lowest.

In the example shown in FIG. 5, the position of LPH 3Y exhibiting the lowest density is 2.368 mm, which is the real focal position.

Since the pattern image outputted on sheet P is visible by an unaided eye, the position of LPH 3Y exhibiting lower density is clearly detected by the unaided eye. Since the numeral and the graduation, displaying the distance between LPH 3Y and photoconductor 1Y, are outputted on recording sheet P for the detection, the position of the highest resolution and the real focal position can be read with ease. However, it is more preferable that the pattern images are read by a scanning densitometer, so that information of read density is used for the detection, which can more correctly detect the focus position, and prevents generation of human error.

The positional adjustment of LPH 3Y is conducted by both position adjustment mechanisms 31 on the near side and the other side, to be the real focal distance exhibiting the highest resolution, based on information of the resolution. In the example in FIG. 5, adjustment is conducted to be 2.368 mm.

Using the above embodiment, the optimum focus position of the LPH can be obtained by a simple and easy structure, and focus adjustment can be conducted. Further, since each end of the LPH can be separately adjusted, the decline of the LPH is also corrected. Due to this, regardless to the place where the image forming apparatus is installed, for example, at a user's office, focus adjusting can be conducted with ease.

Therefore, on the images printed by the image forming apparatus employing the LPH, prevented are defocusing, reduction of the resolution, and color unevenness, which results in the printed images exhibiting the higher resolution.

What is claimed is:

1. A focus adjustment method of an LED print head of an image forming apparatus, wherein the LED print head including an LED array which is structured of plural LEDs to form an electrostatic latent image on a photoconductor and is arranged in a longitudinal direction of the photoconductor, comprising:

setting one end with respect to a longitudinal direction of the LED print head on a first position where a distance between the photoconductor and the LED print head becomes shorter than a designed focal length, and other end with respect to the longitudinal direction of the LED print head on a second position where the distance between the photoconductor and the LED print head becomes longer than the designed focal length;

outputting a pattern image having a predetermined resolution, wherein a high resolution line and a low resolution line are formed by the step of setting one end and other end of the LED print head; and adjusting the position of the LED print head by moving each of the one end and the other end of the LED print head, based on information of the resolution of the outputted pattern image;

wherein the pattern image is formed by lighting the LEDs in a repeating pattern of a lit pair of LEDs adjacent to an unlit pair of LEDs.

2. The focus adjustment method of claim 1, wherein the adjusting step is conducted so that each of the one end and the other end of the LED print head are moved corresponding to a focal length which obtains a highest resolution of the pattern image.

3. The focus adjustment method of claim 1, wherein the resolution of the pattern image is determined based on density of the outputted pattern image, and the adjusting step is conducted so that each of the one end and the other end of the LED print head are moved corresponding to a focal length which obtains a lowest density.

4. The focus adjustment method of claim 1, wherein the pattern image having the predetermined resolution is formed while the LED is activated and deactivated repeatedly in a main scanning direction of the LED print head with respect to each predetermined number of image elements, and the pattern image is formed as a line of a sub-scanning direction.

5. The focus adjustment method of claim 1, wherein information of the resolution of the outputted pattern image corresponds to a density of an image detected by a density detecting section.

6. The focus adjustment method of claim 1, wherein an adjusting scale is provided to the pattern image.

7. The focus adjustment method of claim 1, wherein the one end and the other end of the LED print head are moved by a driving section.

8. The focus adjustment method of claim 1, wherein the pattern image having the predetermined resolution is outputted on a recording sheet.

9. The focus adjustment method of claim 1, wherein the photoconductor is a photoconductive drum.

10. An image forming apparatus including a print head to form an electrostatic latent image on a photoconductor, comprising:

a photoconductor;

an LED print head including an LED array which is structured of plural LEDs to form the electrostatic latent image on the photoconductor and is arranged in a longitudinal direction of the photoconductor;

a position adjusting section which individually moves one end and other end of the LED print head with respect to a longitudinal direction of the LED print head to change a vertical position of the LED print head;

a pattern forming section which forms a pattern image having a predetermined resolution to output, wherein a high resolution line and a low resolution line are formed by adjustments of one end and other end of the LED print head; and a resolution information obtaining section which obtains information of the resolution with respect to the longitudinal direction of the LED print head;

wherein the pattern image is formed by lighting the LEDs in a repeating pattern of a lit pair of LEDs adjacent to an unlit pair of LEDs.

11. The image forming apparatus of claim 10, wherein the resolution information obtaining section provides an adjusting scale to the pattern image.

12. The image forming apparatus of claim 10, wherein the resolution information obtaining section obtains the resolution information from a density detecting section.

13. The image forming apparatus of claim 10, wherein the pattern forming section activates and deactivates the LED repeatedly in a main scanning direction of the LED print head with respect to each predetermined number of image elements and forms the pattern image.

14. The image forming apparatus of claim 13, wherein the pattern image is lined in a sub-scanning direction.

15. The image forming apparatus of claim 10, wherein the pattern forming section outputs the pattern image onto a recording sheet.

16. The image forming apparatus of claim 10, wherein the image forming apparatus includes a plurality of the photoconductors and a plurality of the LED print heads.

* * * * *